United States Patent [19]

Takeuchi et al.

[11] 4,169,728

[45] Oct. 2, 1979

[54] CORROSION RESISTANT BRIGHT ALUMINUM ALLOY FOR DIE-CASTING

[75] Inventors: Yo Takeuchi; Shinichi Komori; Kazuo Toda, all of Urawa; Yasumasa Miyashita, Ohi, all of Japan

[73] Assignees: Mitsubishi Kinzoku Kabushiki Kaisha, Ohtemachi; Shinkoriko Co., Ltd., Kawagoe, both of Japan

[21] Appl. No.: 876,275

[22] Filed: Feb. 9, 1978

[51] Int. Cl.[2] ..... C22C 21/08

[52] U.S. Cl. ..... 75/141; 148/32.5

[58] Field of Search ..... 75/141, 146; 148/32, 148/32.5

[56] References Cited

U.S. PATENT DOCUMENTS

| | | | |
|---|---|---|---|
| 3,345,159 | 10/1967 | Sandor | 75/141 |
| 4,021,271 | 5/1977 | Roberts | 75/141 |

FOREIGN PATENT DOCUMENTS 48-11217 2/1973 Japan .

*Primary Examiner*—R. Dean

*Attorney, Agent, or Firm*—Frishauf, Holtz, Goodman & Woodward

[57] ABSTRACT

A corrosion resistant bright aluminum alloy for die-casting which consisting essentially of, in weight percentage:

| | | |
|---|---|---|
| Zinc | from 0.5 | to 2.5%, |
| Magnesium | from 1.1 | to 3.0%, |
| Silicon | from 0.3 | to 1.2%, |
| Iron | from 0.2 | to 1.5%, |
| Manganese | from 0.3 | to 1.2%, |
| Copper | from 0.1 | to 0.3%, and |
| the balance aluminum and incidental impurities; | | |

said alloy for die-casting further additionally containing from 0.001 to 2.000% in weight percentage in total of at least one element selected from the group consisting of:

| | | |
|---|---|---|
| Titanium | from 0.05 | to 0.30%, |
| Chromium | from 0.05 | to 0.50%, |
| Boron | from 0.01 | to 0.05%, |
| Zirconium | from 0.05 | to 0.30%, |
| Vanadium | from 0.05 | to 0.30%, |
| Cobalt | from 0.05 | to 0.50%, |
| Antimony | from 0.05 | to 0.30%, |
| Nickel | from 0.05 | to 2.00%, and |
| Beryllium | from 0.001 | to 0.005%. |

2 Claims, No Drawings

CORROSION RESISTANT BRIGHT ALUMINUM ALLOY FOR DIE-CASTING

REFERENCE TO PATENT, APPLICATIONS AND PUBLICATIONS PERTINENT TO THE INVENTION

So far as we know, the document pertinent to the present invention is the Japanese Patent Provisional Publication No. 11,217/73.

The contents of the prior art disclosed in the document described above will be described later in the "Background of the Invention".

FIELD OF THE INVENTION

The present invention relates to an aluminum alloy which has a satisfactory die-casting property, gives a die-cast product with a bright surface after an anodic oxidation treatment, and is excellent in corrosion resistance and strength.

BACKGROUND OF THE INVENTION

Conventionally, aluminum and aluminum alloys in such series as Al-Mg, Al-Si, Al-Si-Mg and Al-Si-Cu have widely been used as aluminous materials for die-casting. From among these materials, aluminum which has a lower content of impurities, when used as the material for a die-cast product, is defective in that it is insufficient in strength and tends to easily adhere to a die (i.e., a mold), in contrast to its excellent anodic oxidation treatment property. Aluminum is therefore employed only for the manufacture of a die-cast product with a relatively simple shape and not requiring a high strength. Al-Mg alloys, which have a relatively high magnesium content, exhibit a low fluidity in casting, and are not suitable for the manufacture of a die-cast product having a complicated shape; these alloys are inferior also in brightness after an anodic oxidation treatment. Al-Si, Al-Si-Mg and Al-Si-Cu alloys, which have a satisfactory die-castability, cannot impart a satisfactory brightness to the surface of a die-cast product if subjected to an anodic oxidation treatment, because of relatively high silicon content.

Japanese Patent Provisional Publication No. 11,217/73 discloses a spontaneous coloring aluminum alloy for die-casting which consists of, in weight percentage:

| | | |
|---|---|---|
| Zinc | from 1.0 | to 7.0%, |
| Manganese | from 0.2 | to 2.0%, |
| Chromium | from 0.1 | to 1.0%, |
| Iron | from 0.3 | to 1.5%, and |
| the balance aluminum and incidental impurities; | | |

said alloy for die-casting further additionally containing at least one element selected from the group consisting of, in weight percentage:

| | | |
|---|---|---|
| Magnesium | from 0.1 | to 1.0%, |
| Beryllium | from 0.002 | to 0.01%, |
| Titanium | from 0.01 | to 0.20%, and |
| Silicon | from 0.1 | to 5.0%. |

The aforementioned conventional spontaneous coloring aluminum alloys for die-casting certainly have a satisfactory die-castability and also show excellent corrosion resistance and toughness, giving furthermore a uniform and beautiful tint. However, no consideration is given in said alloys to the brightness after an anodic oxidation treatment.

Thus, the conventional aluminum and aluminum alloys used as materials for die-casting have difficulties in strength, castability or brightness after an anodic oxidation treatment, and aluminum or aluminum alloy simultaneously satisfying these requirements has not as yet been proposed.

SUMMARY OF THE INVENTION

A principal object of the present invention is therefore to provide an aluminum alloy which has a satisfactory die-castability, gives an excellent surface brightness of a die-cast product after an anodic oxidation treatment, and is excellent in corrosion resistance and strength.

In accordance with one of the features of the present invention, there is provided a corrosion resistant bright aluminum alloy for die-casting which consisting essentially of, in weight percentage:

| | | |
|---|---|---|
| Zinc | from 0.5 | to 2.5%, |
| Magnesium | from 1.1 | to 3.0%, |
| Silicon | from 0.3 | to 1.2%, |
| Iron | from 0.2 | to 1.5%, |
| Manganese | from 0.3 | to 1.2%, |
| Copper | from 0.1 | to 0.3%, and |
| the balance aluminum and incidental impurities; | | |

said alloy for die-casting further additionally containing from 0.001 to 2.000% in weight percentage in total of at least one element selected from the group consisting of:

| | | |
|---|---|---|
| Titanium | from 0.05 | to 0.30%, |
| Chromium | from 0.05 | to 0.50%, |
| Boron | from 0.01 | to 0.05%, |
| Zirconium | from 0.05 | to 0.30%, |
| Vanadium | from 0.05 | to 0.30%, |
| Cobalt | from 0.05 | to 0.50%, |
| Antimony | from 0.05 | to 0.30%, |
| Nickel | from 0.05 | to 2.00%, and |
| Beryllium | from 0.001 | to 0.005%. |

DETAILED DESCRIPTION OF PREFERRED EMBODIMENTS

With a view to obtaining an aluminum alloy having satisfactory die-castability, giving an excellent surface brightness of a die-cast product after an anodic oxidation treatment and being excellent in corrosion resistance and strength from the aforementioned point of view, we have carried out extensive studies. As a result, we found that a corrosion resistant bright aluminum alloy for die-casting simultaneously satisfying the above-mentioned requirements by making the alloy a chemical composition consisting essentially of, in weight percentage:

| | | |
|---|---|---|
| Zinc | from 0.5 | to 2.5%, |
| Magnesium | from 1.1 | to 3.0%, |
| Silicon | from 0.3 | to 1.2%, |
| Iron | from 0.2 | to 1.5%, |
| Manganese | from 0.3 | to 1.2%, |
| Copper | from 0.1 | to 0.3%, and |
| the balance aluminum and incidental impurities; | | |

and that the properties of said alloy can further be improved by causing said alloy to further additionally contain from 0.001 to 2.000% in weight percentage in total of at least one element selected from the group consisting of:

| | | |
|---|---|---|
| Titanium | from 0.05 | to 0.30%, |
| Chromium | from 0.05 | to 0.50%, |
| Boron | from 0.01 | to 0.05%, |
| Zirconium | from 0.05 | to 0.30%, |
| Vanadium | from 0.05 | to 0.30%, |
| Cobalt | from 0.05 | to 0.50%, |
| Antimony | from 0.05 | to 0.30%, |
| Nickel | from 0.05 | to 2.00%, and |
| Beryllium | from 0.001 | to 0.005%. |

Now, the reasons for limiting the ranges of the chemical composition of the corrosion resistant bright aluminum alloy for die-casting of the present invention as described above are given below:

(1) Zinc

The zinc constituent has the effect of not only enhancing the strength of an aluminum alloy, but also improving the fluidity of a molten aluminum alloy and the resistance of a die-cast product to casting cracks, thus ensuring satisfactory die-casting of a product of complicated shape. Furthermore, the zinc constituent serves, when die-cast products are subjected to an anodic oxidation treatment, to impart a uniform brightness to the surfaces of said products.

However, a zinc content of under 0.5 wt.% does not permit achievement of the desired effect as described above. If the zinc content is over 2.5 wt.%, on the other hand, die-cast products tend to have casting cracks. Therefore, the zinc content should be within a range of from 0.5 to 2.5 wt.%.

(2) Magnesium

The magnesium constituent has the effect of improving the strength of an aluminum alloy, particularly in coexistence with silicon.

However, with a magnesium content of under 1.1 wt.%, casting cracks tend to occur in die-cast products; and a desired alloy strength cannot be ensured. With a magnesium content of over 3.0 wt.%, on the other hand, not only does the castability worsen, but also the application of an anodic oxidation treatment to die-cast products cannot impart a desired brightness to the surfaces of said products. Therefore, the magnesium content should be within a range of from 1.1 to 3.0 wt.%.

(3) Silicon

The silicon constituent has the effect of improving the castability of an aluminum alloy and also, as mentioned above, of raising the strength of an aluminum alloy through age-hardening in coexistence with the magnesium constituent.

However, with a silicon content of under 0.3 wt.%, especially under 0.2 wt.%, desired effects as mentioned above cannot be obtained. With a silicon content of over 1.2 wt.%, on the other hand, the application of an anodic oxidation treatment to die-cast products cannot ensure a desired surface brightness of said products. Therefore, the silicon content should be within a range of from 0.2 to 1.2 wt.%, preferably from 0.3 to 1.2 wt.%.

(4) Iron

The iron constituent has the effect, in die-casting, of preventing a die-cast product from adhering to a die, i.e., of improving the strippability of an aluminum alloy from a mold.

However, with an iron content of under 0.2 wt.%, desired strippability from a mold cannot be ensured. An iron content of over 1.5 wt.%, on the other hand, causes decrease in corrosion resistance and toughness of an aluminum alloy. Therefore, the iron content should be within a range of from 0.2 to 1.5 wt.%.

(5) Manganese

The manganese constituent has the effect, in die-casting, of preventing the occurrence of casting cracks in die-cast products, and also of improving the strength and the corrosion resistance of an aluminum alloy.

However, with a manganese content of under 0.3 wt.%, desired effects as mentioned above cannot be ensured. With a manganese content of over 1.2 wt.%, on the other hand, the fluidity of a molten aluminum alloy worsens in coexistence with the iron constituent. Therefore, the manganese content should be within a range of from 0.3 to 1.2 wt.%.

(6) Copper

The copper constituent has the effect of improving the strength of an aluminum alloy after an ageing treatment as well as of increasing the surface brightness of die-cast products after an anodic oxidation treatment.

However, with a copper content of under 0.1 wt.%, desired effects as mentioned above cannot be ensured. With a copper content of over 0.3 wt.%, on the other hand, not only do casting cracks tend to occur in die-cast products in carrying out die-casting, but also the corrosion resistance of an aluminum alloy decreases. Therefore, the copper content should be within a range of from 0.1 to 0.3 wt.%.

(7) Titanium, chromium, boron, zirconium, vanadium, cobalt, antimony, nickel and beryllium are elements added as required to further improve the properties of an aluminum alloy such as strength, ductility and brightness.

(a) Titanium, chromium, vanadium and cobalt, having the effect of refining crystal grains of an aluminum alloy, are added when it is necessary to further improve the strength of an aluminum alloy.

However, with the contents of these elements under 0.05 wt.%, respectively, a desired improvement in the strength of an aluminum alloy cannot be ensured. On the other hand, with a titanium content of over 0.30 wt.%, a chromium content of over 0.50 wt.%, a vanadium content of over 0.30 wt.%, and a cobalt content of over 0.50 wt.%, coarse intermetallic compounds are formed, which precipitate in melting an aluminum alloy, and cause decrease in the improving effect of the strength of an aluminum alloy. Therefore, the ranges of the respective contents should be from 0.05 to 0.30 wt.% for titanium, from 0.05 to 0.50 wt.% for chromium, from 0.05 to 0.30 wt.% for vanadium, and from 0.05 to 0.50 wt.% for cobalt.

(b) Boron

The boron constituent, which has the effect of refining crystal grains of an aluminum alloy in coexistence with the titanium constituent, is added when it is necessary to further improve the strength of an aluminum alloy.

However, with a boron content of under 0.01 wt.% desired improvement in the strength of an aluminum alloy cannot be ensured. A boron content of over 0.05 wt.%, on the other hand, does not bring about a particular increase in the strength of an aluminum alloy. Therefore, the boron content should be within a range of from 0.01 to 0.05 wt.%.

(c) Zirconium

The zirconium content, which has the effect of refining cyrstal grains and descreasing pores in an aluminum alloy, is added when it is ncessary to further improve the strength of an aluminum alloy.

However, with a zirconium content of under 0.05 wt.%, desired improvement in the strength of an aluminum alloy cannot be ensured. With a zirconium content of over 0.3 wt.%, on the other hand, coarse intermetallic compounds are formed, which precipitate in melting an aluminum alloy, and cause decrease in the improving effect of the strength of an aluminum alloy. Therefore, the zirconium content should be within a range of from 0.05 to 0.3 wt.%.

(d) Antimony

The antimony constituent, which has the effect of improving the ductility of an aluminum alloy, is added when it is necessary to further improve the ductility of an aluminum alloy.

However, an antimony content of under 0.05 wt.% does not bring about the improving effect of the ductility of an aluminum alloy. With an antimony content of over 0.3 wt.%, on the other hand, it becomes impossible to diffuse the total amount of antimony into an aluminum alloy in the form of solid-solution, thus causing decrease in the improving effect of the ductility of the aluminum alloy. Therefore, the antimony content should be within a range of from 0.05 to 0.30 wt.%.

(e) Nickel

Nickel has the effect of further improving the strength of an aluminum alloy and promoting the surface brightness of die-cast products after the application of an anodic oxidation treatment.

However, with a nickel content of under 0.05 wt.%, desired effects as mentioned above cannot be obtained. With a nickel content of over 2.00 wt.%, on the other hand, the surface brightness of die-cast products worsens after an anodic oxidation treatment. Therefore, the nickel content should be within a range of from 0.05 to 2.00 wt.%.

(f) Beryllium

The beryllium constituent has the effect of not only further improving the fluidity of a molten aluminum alloy, but also refining iron compounds in an aluminum alloy, thus improving the mechanical properties of the aluminum alloy. Furthermore, the beryllium constituent has the effect of preventing the magnesium constituent from being exhausted by oxidation.

However, with a beryllium content of under 0.001 wt.%, desired effects as mentioned above cannot be obtained. A beryllium content of over 0.005 wt.%, on the other hand, does not give a particular improving effect. Therefore, the beryllium content should be within a range of from 0.001 to 0.005 wt.%.

Now, the aluminum alloy of the present invention is described more in detail in comparison with reference aluminum alloys (hereinafter referred to as "the reference alloys") by means of an example.

EXAMPLE

Test pieces having a thickness of 3 mm, a width of 30 mm and a length of 100 mm were each prepared from aluminum alloys 1 to 11 of the present invention (hereinafter referred to as "the alloys" of the present invention) and reference alloys 1 to 14 outside the scope of the present invention, having respective chemical compositions as shown in Table 1, by melting these alloys, and die-casting respective molten alloys by a 150-ton cold chamber die-casting machine at a casting temperature of 710° C., a mold temperature of 200° C., under an injecting pressure of about 1,000 kg/cm$^2$ and at an injecting rate of from 20 to 25 meters per second. In Table 1, alloy 1 of the present invention consists of the absolutely indispensable constituents in the present invention, i.e., aluminum, zinc, magnesium, silicon, iron, manganese and copper; alloys 2 to 11 of the present invention contain, in addition to the above-mentioned absolutely indispensable constituents, from 0.001 to 2.000 wt.% in total of at least one element selected from the optional constituents, i.e., titanium, chromium, boron, zirconium, vanadium, cobalt, antimony, nickel and beryllium. Reference alloys 13 and 14 are aluminum alloys having chemical compositions corresponding respectively to JIS (abbreviation of the Japan Industrial Standard) ADC 6 and JIS ADC 12.

Table 1

| Kind of alloy | | Chemical composition (wt. %) | | | | | | | | | | | | | | | | |
|---|---|---|---|---|---|---|---|---|---|---|---|---|---|---|---|---|---|---|
| | | Zn | mg | Si | Fe | Mn | Cu | Ti | Cr | B | Zr | V | Co | Sb | Ni | Be | Sn | Al |
| Alloy of the present invention | 1 | 1.28 | 1.31 | 0.56 | 0.98 | 0.63 | 0.12 | AA | — | — | — | — | — | — | — | — | — | balance |
| | 2 | 1.30 | 1.29 | 0.57 | 1.00 | 0.71 | 0.13 | 0.15 | — | — | — | — | — | — | — | — | — | " |
| | 3 | 1.29 | 1.32 | 0.53 | 1.06 | 0.67 | 0.13 | — | 0.25 | — | — | — | — | — | — | — | — | " |
| | 4 | 1.26 | 1.34 | 0.47 | 0.76 | 0.65 | 0.12 | — | — | 0.02 | — | — | — | — | — | — | — | " |
| | 5 | 1.31 | 1.35 | 0.51 | 0.93 | 0.70 | 0.13 | — | — | — | 0.21 | — | — | — | — | — | — | " |
| | 6 | 1.29 | 1.37 | 0.48 | 0.96 | 0.78 | 0.14 | — | — | — | — | 0.18 | — | — | — | — | — | " |
| | 7 | 1.32 | 1.38 | 0.49 | 0.94 | 0.70 | 0.13 | — | — | — | — | — | 0.31 | — | — | — | — | " |
| | 8 | 1.31 | 1.40 | 0.43 | 0.98 | 0.73 | 0.13 | — | — | — | — | — | — | 0.21 | — | — | — | " |
| | 9 | 1.30 | 1.40 | 0.50 | 0.89 | 0.69 | 0.13 | — | — | — | — | — | — | — | 1.2 | — | — | " |
| | 10 | 1.29 | 1.42 | 0.41 | 0.92 | 0.70 | 0.14 | — | — | — | — | — | — | — | — | 0.003 | — | " |
| | 11 | 1.28 | 1.41 | 0.43 | 0.89 | 0.69 | 0.12 | 0.15 | — | 0.02 | — | — | — | — | — | — | — | " |
| Reference alloy | 1 | 0.40 | 1.38 | 0.48 | 0.89 | 0.68 | 0.12 | — | — | — | — | — | — | — | — | — | — | " |
| | 2 | 3.21 | 1.20 | 0.43 | 0.90 | 0.71 | 0.12 | — | — | — | — | — | — | — | — | — | — | " |
| | 3 | 1.31 | 0.90 | 0.51 | 0.91 | 0.70 | 0.13 | — | — | — | — | — | — | — | — | — | — | " |
| | 4 | 1.37 | 3.52 | 0.49 | 0.89 | 0.69 | 0.13 | — | — | — | — | — | — | — | — | — | — | " |
| | 5 | 1.38 | 1.42 | 0.18 | 0.91 | 0.69 | 0.13 | — | — | — | — | — | — | — | — | — | — | " |
| | 6 | 1.39 | 1.38 | 1.36 | 0.92 | 0.67 | 0.14 | — | — | — | — | — | — | — | — | — | — | " |
| | 7 | 1.32 | 1.41 | 0.47 | 0.18 | 0.72 | 0.13 | — | — | — | — | — | — | — | — | — | — | " |
| | 8 | 1.39 | 1.43 | 0.47 | 1.71 | 0.73 | 0.12 | — | — | — | — | — | — | — | — | — | — | " |
| | 9 | 1.42 | 1.41 | 0.43 | 0.98 | 0.04 | 0.12 | — | — | — | — | — | — | — | — | — | — | " |
| | 10 | 1.39 | 1.46 | 0.43 | 0.89 | 1.42 | 0.14 | — | — | — | — | — | — | — | — | — | — | " |

Table 1-continued

| Kind of alloy | Chemical composition (wt. %) | | | | | | | | | | | | | | | | |
|---|---|---|---|---|---|---|---|---|---|---|---|---|---|---|---|---|---|
| | Zn | mg | Si | Fe | Mn | Cu | Ti | Cr | B | Zr | V | Co | Sb | Ni | Be | Sn | Al |
| 11 | 1.33 | 1.42 | 0.45 | 0.87 | 0.68 | 0.02 | — | — | — | — | — | — | — | — | — | — | " |
| 12 | 1.36 | 1.38 | 0.49 | 0.90 | 0.72 | 0.41 | — | — | — | — | — | — | — | — | — | — | " |
| 13 | 0.12 | 3.30 | 0.56 | 0.32 | 0.45 | 0.02 | — | — | — | — | — | — | 0.06 | — | — | 0.04 | " |
| 14 | 0.51 | 0.16 | 11.2 | 0.45 | 0.32 | 2.1 | — | — | — | — | — | — | 0.34 | — | — | 0.13 | " |

Table 2 gives results of a comprehensive evaluation based on the observation of the castability, i.e., the fluidity, the strippability from a mold, the casting crack sensitivity and the surface quality, at the time of die-casting of the aforementioned test pieces 1 to 11 of the alloys of the present invention and test pieces 1 to 14 of the reference alloys outside the scope of the present invention. In Table 2, "A" indicates good, B, ordinary, and C, rejectable.

Table 2

| Kind of alloy | Castability | | | | | | | | | | | | | | | | | | | | | | | |
|---|---|---|---|---|---|---|---|---|---|---|---|---|---|---|---|---|---|---|---|---|---|---|---|---|
| | Alloy of the present invention | | | | | | | | | | | Reference alloy | | | | | | | | | | | | |
| | 1 | 2 | 3 | 4 | 5 | 6 | 7 | 8 | 9 | 10 | 11 | 1 | 2 | 3 | 4 | 5 | 6 | 7 | 8 | 9 | 10 | 11 | 12 | 13 | 14 |
| Evaluation | A | A | A | A | A | A | A | A | A | A | A | B | C | C | B | A | A | C | B | C | B | A | C | C | A |

Table 3

| Kind of alloy | Brightness after anodic oxidation treatment | | | | | | | | | | | | | | | | | | | | | | | |
|---|---|---|---|---|---|---|---|---|---|---|---|---|---|---|---|---|---|---|---|---|---|---|---|---|
| | Alloy of the present invention | | | | | | | | | | | Reference alloy | | | | | | | | | | | | |
| | 1 | 2 | 3 | 4 | 5 | 6 | 7 | 8 | 9 | 10 | 11 | 1 | 2 | 3 | 4 | 5 | 6 | 7 | 8 | 9 | 10 | 11 | 12 | 13 | 14 |
| Evaluation | A | A | A | A | A | A | A | A | A | A | A | C | B | B | B | A | C | C | C | B | C | B | A | B | C |

Table 4

| Kind of alloy | Corrosion resistance | | | | | | | | | | | | | | | | | | | | | | | | |
|---|---|---|---|---|---|---|---|---|---|---|---|---|---|---|---|---|---|---|---|---|---|---|---|---|---|
| | Alloy of the present invention | | | | | | | | | | | Reference alloy | | | | | | | | | | | | | |
| | 1 | 2 | 3 | 4 | 5 | 6 | 7 | 8 | 9 | 10 | 11 | 1 | 2 | 3 | 4 | 5 | 6 | 7 | 8 | 9 | 10 | 11 | 12 | 13 | 14 |
| Weight less by corrosion ($mg/dm^2/day$) | 5.6 | 5.8 | 5.7 | 5.5 | 5.5 | 5.7 | 5.6 | 5.5 | 5.8 | 5.9 | 5.4 | 5.9 | 9.1 | 6.5 | 5.0 | 5.5 | 11.4 | 5.6 | 13.3 | 5.5 | 5.7 | 5.8 | 12.0 | 4.6 | 71.8 |

As shown in Table 2, all alloys 1 to 11 of the present invention exhibited a good castability, whereas not a few of reference alloys 1 to 14 showed an inferior castability. More specifically, while reference alloys 5, 6, 11 and 14 demonstrated a satisfactory castability, an insufficient fluidity caused casting wrinkles in reference alloy 1 having a zinc content of under the lower limit of the zinc content for the alloys of the present invention; casting cracks occurred in reference alloy 2 having a zinc content of over the upper limit of the zinc content for the alloys of the present invention; casting cracks occurred in reference alloy 3 having a magnesium content of under the lower limit of the magnesium content for the alloys of the present invention; serious casting wrinkles were caused by an insufficient fluidity in reference alloy 4 having a magnesium content of over the upper limit of the magnesium content for the alloys of the present invention; reference alloy 7 having an iron content of under the lower limit of the iron content for the alloys of the present invention partially adhered to the mold because of inferior strippability from a mold; casting cracks occurred in reference alloy 9 having a manganese content of under the lower limit of the manganese content for the alloys of the present invention; casting wrinkles were caused by an insufficient fluidity in reference alloy 10 having a manganese content of over the upper limit of the manganese content for the alloys of the present invention; and casting cracks occurred in reference alloy 12 having a copper content over the upper limit of the copper content for the alloys of the present invention. As described above, reference alloys 13 and 14 are aluminum alloys having chemical compositions respectively corresponding to the typical aluminum alloys for die-casting known as JIS ADC 6 and JIS ADC 12. While reference alloy 14 showed a good castability, serious casting wrinkles were caused in reference alloy 13 because of insufficient fluidity.

Table 3 gives results of comprehensive evaluation based on the observation of the surface quality after the application of an anodic oxidation treatment to the test pieces of the alloys 1 to 11 of the present invention and the test pieces of reference alloys 1 to 14. In Table 3, "A" represents good, "B", ordinary, and "C", rejectable. The evaluation shown in Table 3 is based on the observation of the surface condition after a #600 emery-polishing and a chemical polishing followed by an anodic oxidation treatment of each test piece.

As shown in Table 3, all alloys 1 to 11 of the present invention presented silvery surfaces with a uniform brightness. Reference alloys 2, 5, 7, 9 and 12 demonstrated a relatively good brightness after an anodic oxidation treatment, whereas such a satisfactory brightness as in alloys 1 to 11 of the present invention could not be obtained in reference alloys 1, 3, 4, 6, 8, 10, 11, 13 and 14 after an anodic oxidation treatment.

Then after a barrel-polishing the test pieces of alloys 1 to 11 of the present invention and the test pieces of reference alloys 1 to 14 in the as-cast state, were subjected to a 24-hour salt spray test to measure the weight loss by corrosion for each test piece. Results of measurement are given in Table 4. The measured values shown in Table 4 are averages over five test pieces.

As is evident from Table 4, alloys 1 to 11 of the present invention show a corrosion resistance almost comparable with the corrosion resistance of JIS ADC 6, i.e., reference alloy 13, known to be excellent in corrosion resistance, the weight loss by corrosion in these alloys of the present invention being only about one third that in JIS ADC 12, i.e., reference alloy 14, known as the representative of the aluminum alloys for die-casting, thus proving the superiority of the alloys of the present invention in corrosion resistance. Reference alloys 6, 8 and 12 having contents of silicon, iron and copper, which adversely affect corrosion resistance, of over the respective upper limits for the alloys of the present invention are far inferior to alloys of the present invention in corrosion resistance.

Then, a one-week salt spray test and a CASS test (abbreviation of Copper-accelerated Acetic acid Salt spray test) specified in JIS H8601 were applied to each of alloys 1 to 11 of the present invention previously subjected to an anodic oxidation treatment. While the salt spray tests showed no surface abnormality, the CASS tests revealed, with rating numbers of 9 to 10, that an anodic oxidation treatment can impart to the alloys of the present invention further excellent corrosion resistance. Furthermore, various dyeing tests carried out on alloys 1 to 11 of the present invention after an anodic oxidation treatment gave desired colors with a uniform brightness, and thus evidenced the superiority of the alloys of the present invention in dye-affinity.

Then, the mechanical properties of alloys 1 to 11 of the present invention and reference alloys 1 to 14 were measured in the as-cast state and in the state subjected to an artificial ageing treatment by holding at a temperature of 170° C. for 15 hours in open air. Results of said measurement are shown in Table 5. The measured values shown in Table 5 are averages over five test pieces. In Table 5, the impact values represent measured values based on the impact test specified in JIS H5302. No measurement of mechanical properties was made as to reference alloys 2, 3, 9 and 12 in which a lower castability caused casting cracks and as to reference alloy 7 which partially adhered to the mold because of inferior strippability from a mold. Mechanical properties after artificial ageing treatment were not measured as to reference alloys 13 and 14 poor in the effect of heat treatment.

Table 5

| Kind of alloy | Mechanical strength | Mechanical properties: As-cast: Tensile strength (kg/mm²) | As-cast: Yield strength (kg/mm²) | As-cast: Elongation (%) | As-cast: Hardness 5kg (HV) | As-cast: Impact value (kg-m/cm²) | Held for 15 hours at 170° C.: Tensile strength (kg/mm²) | Held for 15 hours at 170° C.: Yield strength (kg/mm²) | Held for 15 hours at 170° C.: Elongation (%) | Held for 15 hours at 170° C.: Hardness 5kg (HV) | Held for 15 hours at 170° C.: Impact value (kg-m/cm²) |
|---|---|---|---|---|---|---|---|---|---|---|---|
| Alloy of the present invention | 1 | 24.1 | 13.2 | 13.0 | 82.0 | 4.6 | 26.3 | 17.9 | 8.5 | 105 | 3.6 |
| | 2 | 24.2 | 13.4 | 13.0 | 82.4 | 4.6 | 26.1 | 18.6 | 8.5 | 105 | 3.6 |
| | 3 | 25.1 | 14.4 | 13.2 | 82.6 | 4.8 | 26.8 | 19.2 | 8.2 | 106 | 3.8 |
| | 4 | 25.0 | 14.6 | 14.5 | 82.7 | 4.9 | 27.1 | 20.1 | 8.4 | 107 | 3.3 |
| | 5 | 24.2 | 13.5 | 13.6 | 82.7 | 4.5 | 27.8 | 19.1 | 8.9 | 107 | 3.5 |
| | 6 | 25.0 | 14.7 | 13.0 | 82.4 | 4.5 | 26.9 | 19.0 | 8.3 | 107 | 3.6 |
| | 7 | 24.8 | 14.6 | 12.7 | 82.1 | 4.7 | 27.3 | 18.3 | 8.6 | 108 | 3.4 |
| | 8 | 25.3 | 14.0 | 13.9 | 84.1 | 4.5 | 28.6 | 18.0 | 9.2 | 107 | 3.6 |
| | 9 | 26.3 | 14.1 | 14.6 | 84.1 | 4.6 | 28.7 | 19.3 | 8.2 | 105 | 3.4 |
| | 10 | 25.0 | 13.6 | 13.2 | 84.0 | 4.5 | 26.7 | 18.3 | 8.9 | 107 | 3.6 |
| | 11 | 25.2 | 14.3 | 13.8 | 82.3 | 4.5 | 27.2 | 18.7 | 8.4 | 106 | 3.7 |
| Reference alloy | 1 | 24.0 | 13.1 | 12.8 | 82.0 | 4.6 | 26.0 | 7.7 | 8.6 | 104 | 3.6 |
| | 2 | — | — | — | — | — | — | — | — | — | — |
| | 3 | — | — | — | — | — | — | — | — | — | — |
| | 4 | 22.1 | 11.8 | 8.1 | 82.5 | 4.6 | — | — | — | — | — |
| | 5 | 23.2 | 12.0 | 13.4 | 82.0 | 4.8 | 25.0 | 15.4 | 9.8 | 96 | 3.8 |
| | 6 | 25.0 | 14.3 | 7.1 | 82.6 | 4.1 | 27.4 | 19.0 | 5.9 | 108 | 3.1 |
| | 7 | — | — | — | — | — | — | — | — | — | — |
| | 8 | 25.0 | 14.4 | 9.8 | 82.7 | 4.3 | 26.9 | 18.0 | 6.0 | 107 | 3.2 |
| | 9 | — | — | — | — | — | — | — | — | — | — |
| | 10 | 24.1 | 13.2 | 10.0 | 81.0 | 4.3 | 25.4 | 16.0 | 8.1 | 97 | 3.4 |
| | 11 | 24.6 | 13.4 | 13.5 | 81.5 | 4.6 | 25.0 | 15.8 | 8.9 | 95 | 3.7 |
| | 12 | — | — | — | — | — | — | — | — | — | — |
| | 13 | 21.2 | 10.8 | 7.1 | 82.3 | 4.6 | — | — | — | — | — |
| | 14 | 25.3 | 16.7 | 1.6 | 119.4 | 1.2 | — | — | — | — | — |

As is clear from Table 5, in the as-cast state, alloys 1 to 11 of the present invention show, as compared with reference alloys 1 to 13, superior values in tensile strength, yield strength and elongation and exhibit hardness and impact values equal or superior to those of reference alloys 1 to 13.

After the application of an artificial ageing treatment, alloys 1 to 11 of the present invention have mechanical properties superior to those of as-cast alloys 1 to 11 of the present invention except for the elongation and impact values. Furthermore, even in comparison with JIS ADC 12, i.e., reference alloy 14, which has the highest strength among reference alloys 1 to 14, alloys 1 to 11 of the present invention after artificial ageing are far superior in tensile strength, yield strength, elongation and impact values except only for the hardness which is slightly lower. The alloys of the present invention, which have excellent mechanical properties even in the as-cast state, show further improved mechanical properties through the application of an artificial ageing treatment.

As is evident from the results shown in Table 5, alloys 2 to 11 of the present invention containing optional constituents such as titanium, chromium, boron, zirconium, vandium, cobalt, antimony, nickel and beryllium in addition to the absolutely indispensable constituents have relatively superior mechanical properties to those of alloy 1 of the present invention consisting only of indispensable constituents, under the effects of the above-mentioned additional elements.

As described above in detail, aluminum alloys having a chemical composition outside the scope of the chemical composition for the alloy of the present invention cannot be provided simultaneously with all of the desired properties including castability, brightness after an anodic oxidation treatment, corrosion resistance and strength, irrespective of which of the constituents is out of the scope of chemical composition for the alloy of the present invention. According to the present invention, therefore, it is possible to obtain an aluminum alloy having a satisfactory die-castability, excellent in the surface brightness of die-cast products after an anodic oxidation treatment as well as in corrosion resistance and strength, thus, providing industrially useful effects.

What is claimed is:

1. A corrosion resistant bright aluminum alloy for die-casting consisting essentially of, in weight percentage:

| | | |
|---|---|---|
| Zinc | from 0.5 | to 2.5%, |
| Magnesium | from 1.1 | to 3.0%, |
| Silicon | from 0.3 | to 1.2%, |
| Iron | from 0.2 | to 1.5%, |
| Manganese | from 0.3 | to 1.2%, |
| Copper | from 0.1 | to 0.3%, and |
| the balance aluminum and incidental impurities. | | |

2. A corrosion resistant bright aluminum alloy for die-casting consisting essentially of, in weight percentage:

| | | |
|---|---|---|
| zinc | from 0.5 | to 2.5%, |
| magnesium | from 1.1 | to 3.0%, |
| silicon | from 0.3 | to 1.2%, |
| iron | from 0.2 | to 1.5%, |
| manganese | from 0.3 | to 1.2%, |
| copper | from 0.1 | to 0.3%, |

and from 0.001 to 2% in weight percentage in total of at least one element selected from the group consisting of:

| | | |
|---|---|---|
| titanium | from 0.05 | to 0.30%, |
| chromium | from 0.05 | to 0.50%, |
| boron | from 0.01 | to 0.05%, |
| zirconium | from 0.05 | to 0.30%, |
| vanadium | from 0.05 | to 0.30%, |
| cobalt | from 0.05 | to 0.50%, |
| antimony | from 0.05 | to 0.30%, |
| nickel | from 0.05 | to 2.00%, |
| beryllium | from 0.001 | to 0.005%, |
| and the balance aluminum and incidental impurities. | | |

* * * * *